United States Patent [19]

Pavlica et al.

[11] 4,192,734

[45] Mar. 11, 1980

[54] PRODUCTION OF HIGH QUALITY FUEL OILS

[75] Inventors: Robert T. Pavlica, Princeton; Thomas R. Stein, Cherry Hill; Carl W. Streed, Haddonfield, all of N.J.

[73] Assignee: Mobil Oil Corporation, New York, N.Y.

[21] Appl. No.: 922,948

[22] Filed: Jul. 10, 1978

[51] Int. Cl.[2] ..... C10G 37/04; C10G 39/00

[52] U.S. Cl. ..... 208/80; 208/93; 208/94

[58] Field of Search ..... 208/80, 93, 94

[56] References Cited

U.S. PATENT DOCUMENTS

| | | | |
|---|---|---|---|
| 3,175,966 | 3/1965 | Burch | 208/80 |
| 3,702,886 | 11/1972 | Argauer et al. | 208/111 |
| 3,723,295 | 3/1973 | Kress | 208/93 |
| 3,894,933 | 7/1975 | Owen et al. | 208/74 |
| 3,928,175 | 12/1975 | Owen | 208/80 |
| 4,120,778 | 10/1978 | Goudriaan et al. | 208/80 |

*Primary Examiner*—Herbert Levine

*Attorney, Agent, or Firm*—Charles A. Huggett; Carl D. Farnsworth

[57] ABSTRACT

A processing arrangement for upgrading crude oil by the combination of hydrodewaxing, and fluid catalytic cracking or hydrocracking to maximize the production of low pour, high quality distillate fuel oil is particularly described. Cracking of atmospheric bottoms of residua, hydrodewaxing atmospheric heavy gas oil and hydrodesulfurizing light gas oil material to produce diesel fuel oil products are primary components of the processing arrangement.

10 Claims, 1 Drawing Figure

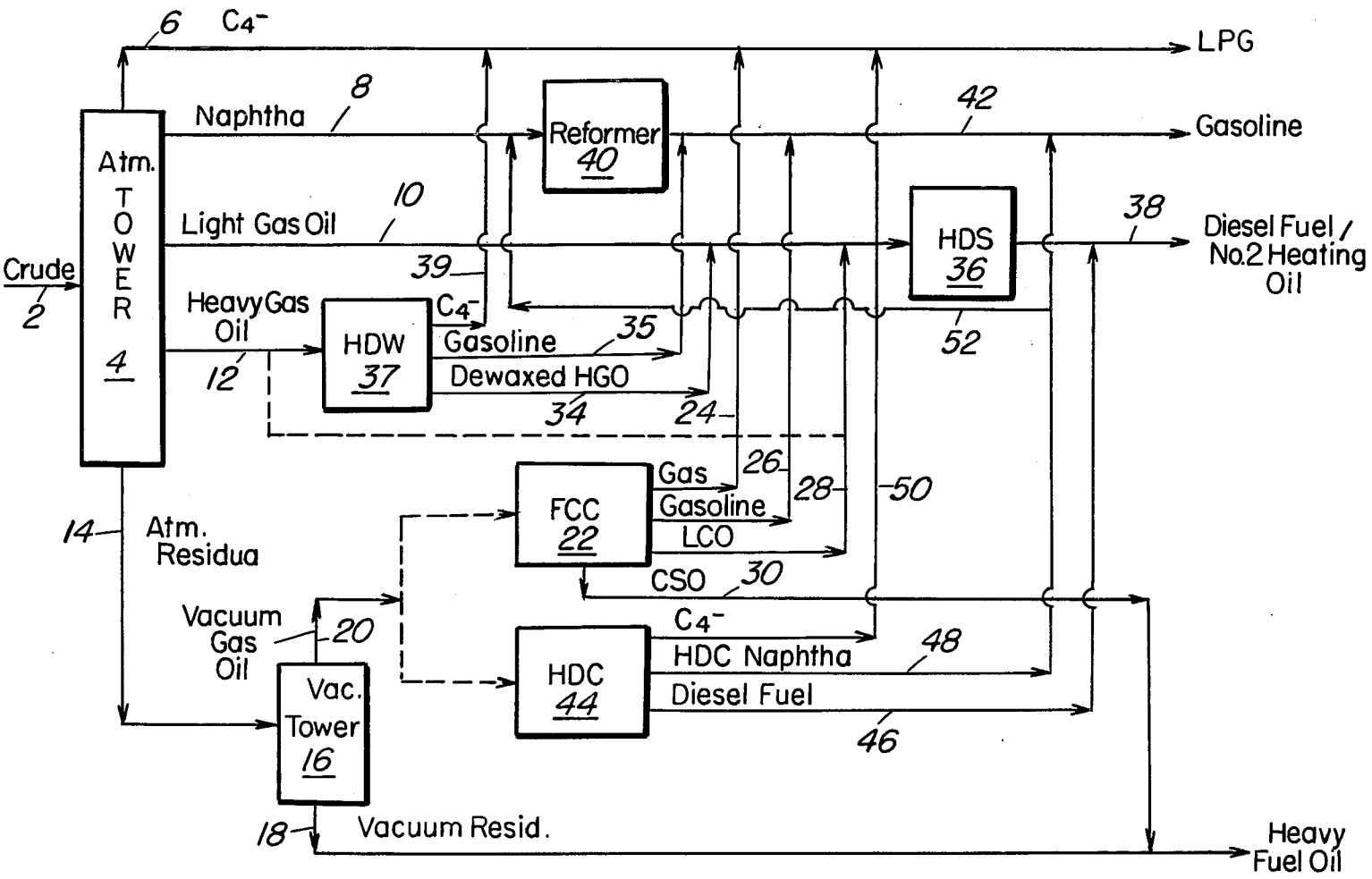
LPG
Gasoline
Diesel Fuel / No.2 Heating Oil
Heavy Fuel Oil
38
42
HDS 36
52
50
48
46
28
26
30
24
Reformer 40
35
34
Gas
Gasoline
LCO
CSO
C4-
HDC Naphtha
Diesel Fuel
FCC 22
HDC 44
Vacuum Resid.
C4-
Gasoline
Dewaxed HGO
39
HDW 37
10
8
20
Vac. Tower 16
18
Naphtha
Light Gas Oil
Heavy Gas Oil
12
Vacuum Gas Oil
Atm. Residua
6
Atm. TOWER 4
14
Crude
2

PRODUCTION OF HIGH QUALITY FUEL OILS

BACKGROUND OF THE INVENTION

A projection of petroleum product trends identifies a large increase in distillate demands, particularly diesel fuel. Refiners are well aware of the processing variables available to them for increasing distillate production in a catalytic cracking operation. U.S. Pat. Nos. 3,894,931 and 3,894,933 address themselves to such operations. By a proper selection of FCC processing variables at low conversion and innovations involving catalyst type and high recycle of heavy cycle oil, distillate yield can be increased some considerable amount at the expense of gasoline yield. An increase by about 40% volume based on fresh feed in not unexpected. The yield of such distillate material may be substantially maximized by combining a hydrodewaxing operation in a manner to control cloud and pour points of distillate fuels obtained by the combination.

The processing arrangement of the present invention demonstrates how diesel fuels of high quality can be produced by blending a light fuel oil product of cracking, whether obtained by fluid catalytic cracking or hydrocracking, with a higher boiling dewaxed atmospheric gas oil and lighter virgin gas oil.

SUMMARY OF THE INVENTION

The processing arrangement of the present invention is concerned with separating and processing a light oil product of cracking, a light atmospheric gas oil, and a dewaxed atmospheric heavy gas oil which is thereafter blended and desulfurization as required to produce diesel fuel as well as No. 2 heating oil. It has been found that diesel fuels produced by the combination operation of this invention may be of a higher end boiling point and thus wider boiling range than currently permitted by ASTM specifications and limited by volatility specification requirements. The fuel oil product of the process combination herein described are equal in cleanliness and performance to lower end point fuels produced by other arrangements.

An FCC (fluid catalytic cracking) unit has the inherent capability for maximizing the yield of light cycle oil (LCO) from a given oil feed. As the FCC unit operation is shifted from a gasoline producing mode, for example, into a maximum distillate producing mode or operation, the light cycle oil (LCO) cetane quality improves and thus can be used for blending to form a diesel fuel product. On the other hand, a hydrocracking operation also has the inherent capability of producing large yields of fuel oil products as compared to gasoline boiling products. Thus, either one or both of these operations may be relied upon for upgrading an atmospheric residua and/or portions thereof higher boiling than heavy atmospheric gas oil. That is, atmospheric heavy gas oil with an end boiling point in the range of 750° to 950° F. may be particularly selected for the production of fuel oils by hydrodewaxing with higher boiling portions of the crude being processed by one of fluid catalysts cracking or hydrocracking to additional fuel oil product.

The catalytic reforming of low octane naphthas obtained from crude oil as atmospheric or straight run naphthas, low severity hydrocracking operations and other refinery sources has been discussed in more than one patent of the prior art. See U.S. Pat. Nos. 3,502,573, 3,247,099, 3,649,524. Initially, the upgrading of low octane naphthas boiling up to 380° F. or 400° F. was promoted by reforming in the presence of platinum-alumina-halogen promoted reforming catalysts. The reforming operation of the regenerative or semi-regenerative type of operation was effected in a plurality of sequentially arranged reaction zones maintained under conditions to promote dehydrogenation, isomerization, cyclization and some hydrocracking. The reforming operation was later modified to encompass the use of bimetallic reforming catalysts under carefully controlled conditions of moisture and halogen atmosphere. Octane upgrading naphthas to 90 octane and above was accomplished as required by varying the severity of the operating conditions employed. A further octane boost could be obtained by relying upon shape selective catalysts to remove by conversion the least desirable low octane components of the reformate product. Thus, it was not unusual to process naphthas obtained from any available source and having an end boiling point within the range of 320° F. up to 400° F. by catalytic reforming to obtain reformate products of an octane rating in the range of 90 to 105 (R+O). Straight run naphthas and naphtha products of cracking often were charged as feed to catalysts reforming for octane improvement.

The hydrodesulfurizing of atmospheric fractions comprising naphthas and higher boiling materials has also been the subject of considerable discussion in the prior art. See U.S. Pat. No. 3,011,971 for example. Numerous other patents also bear on such feed desulfurizing operations. As the sulfur concentration and boiling range of the charge to be desulfurized is increased, so also generally are the operating severity conditions required to effectively remove sulfur contaminants to a desired low level. Thus, the desulfurizing of light and heavy gas oils has been practiced to some extent before further processing as by cracking and hydrocracking operations to produce desired products. Generally, the desulfurizing of the gas oil boiling fraction is accomplished at a temperature within the range of 500° to 800° F. at a total pressure within the range of 300 to 1500 psig. As mentioned above, the severity of the operation will be adjusted depending upon the oil charged, its sulfur and nitrogen concentration and the extent of removal of sulfur and nitrogen desired.

The catalytic dewaxing of oil fractions of various boiling range has also been the subject of patent coverage as evidenced by U.S. Pat. Nos. 3,894,938, Re. 28,398, 3,668,113 and 3,700,585. In U.S. Pat. No. 3,894,938, the dewaxing and desulfurization of high pour, high sulfur gas oils is discussed by contacting with a special class of crystalline zeolite in a hydrodewaxing operation followed by more severe treatment of the dewaxed material in a desulfurizing operation. Dewaxing over the special zeolite catalyst is accomplished at a temperature within the range of 300° to 850° F. at a pressure from atmospheric pressure up to about 2,000 psig. Desulfurizing of the dewaxed oil may be further accomplished by contacting a desulfurizing catalyst known in the prior art with hydrogen at a temperature within the range of 550° F. to 800° F. at a pressure within the range of 200 to 1,000 psig and from about 0.5 to about 5.0 liquid hourly space velocity (LHSV).

In the combination operation of this invention, a heavy atmospheric gas oil separated from crude oil is hydrodewaxed and desulfurized with the remaining bottom portion of the crude boiling above about 750° or 775° F. being processed to separate vacuum gas oils before processing thereof by one of catalytic cracking in the presence or absence of hydrogen. Thus, the heavy vacuum gas oil portion of the crude oil may be processed as by fluid catalytic cracking to preferentially produce fuel oil or by hydrocracking to particularly produce fuel oils. The processing of heavy feeds such as gas oils by fluid catalytic cracking to produce high yields of fuel oils has been the subject of several patents including U.S. Pat. Nos. 3,894,931, 3,894,933, 3,896,024 and 3,891,540. Thus, in such fluid cracking operations, the operating techniques may be varied considerably depending upon the results desired. In this fluid catalyst cracking operation, it is particularly preferred to employ processing technology including temperature operating conditions within the range of about 900° F. to about 1050° F. in combination with catalyst activity and a severity of use comprising residence contact time between catalyst and hydrocarbon particularly promoting the optimization of fuel oil boiling range products in the diesel fuel and No. 2 fuel oil boiling range. Generally the residence contact time will be less than about 10 seconds and more usually will be no more than 2 to 8 seconds.

In yet another embodiment, it is contemplated processing the crude atmospheric residua in a manner to acquire vacuum gas oils boiling above about 750° F. as distinguished from higher boiling vacuum resid. The vacuum gas oils are thereafter processed in this embodiment with hydrogen over a suitable hydrocracking catalyst. Hydrocracking is well known in the petroleum industry and refers to the treatment of relatively heavy hydrogen deficient hydrocarbons with a hydrogen rich gas stream under selected conditions of temperature and elevated pressure such that carbon to carbon linkages are cleaved and hydrogen is added to the cracked molecular fragments to produce smaller, more stable molecules containing a higher percentage of hydrogen. The reactions of hydrocracking include the splitting of long chain paraffins and the saturation of olefins as well as the reduction of aromatics to corresponding naphthenes, the opening of aromatic or naphthenic rings to form branched chain paraffins or monocyclic compounds and alkyl compounds. The prior art has suggested the use of numerous catalyst in hydrocracking operations which include amorphous and/or crystalline silica-alumina cracking components such as crystalline zeolites. These catalysts often include the oxides and sulfides of molybdenum and tungsten, mixed metal catalysts such as, nickel-copper, nickel-alumina, cobalt molybdate, copper-zinc oxide and nickel-tungsten containing catalysts. Hydrocracking catalyst of greater activity and selectivity utilized the combination of a solid acidic cracking component or base in admixture with an active hydrogenating metal or metals component. The acidic cracking component is usually selected from the group comprising silica-alumina, silica-zirconia, silica-magnesia, silica-boria, silica-alumina-zirconia and one or more crystalline zeolites providing a pore opening of at least 5 Angstroms. The crystalline aluminosilicate may be a metal promoted faujasite zeolite or a zeolite of the class represented by ZSM-5 having cracking activity as well as particularly desired catalyst conversion selectivity. The hydrocracking operation contemplated employing one of the catalysts identified is generally accomplished at a temperature below 900° F. and, more usually, is within the range of 600° F. up to about 900° F. relying upon elevated operating pressures above 500 psig and up to about 2,500 psig or higher to achieve the desired severity of cracking. The catalyst selected will also depend upon the severity of operating conditions desired or required.

DISCUSSION OF SPECIFIC EMBODIMENTS

The drawing identifies a particular arrangement of processing steps according to the invention for upgrading crude oil to substantially maximize distillate product yield comprising particularly diesel fuel and/or No. 2 fuel oil relying particularly upon the technology of cracking, with or without hydrogen in combination with a special hydrodewaxing operation and hydrodesulfurizing technology to provide results desired.

Referring now to the drawing, by way of example, a wide boiling range crude oil is charged by conduit 2 to an atmospheric distillation or fractionation tower represented by arrangement 4 wherein a separation of the crude is made to separate and recover, a $C_4$ minus fraction by conduit 6, a straight run naphtha fraction withdrawn by conduit 8, a light atmospheric gas oil (LGO) recovered by conduit 10, a heavy atmospheric gas oil recovered by conduit 12, and an atmospheric residua recovered from a bottom portion of the atmospheric tower by conduit 14. The atmospheric distillation of the crude oil charged is effected under conditions and arrangement of the equipment to permit the recovery of a light gas oil providing an end boiling point within the range of 640° F. to about 660° F., a heavy gas oil with an end boiling point within the range of 750° to 950° F. and an atmospheric bottoms boiling above 750° F. and, more usually, above about 775° F. and as high as 950° F. An end boiling point of about 775° F. for the heavy gas oil fraction is particularly selected because of volatility specification requirement now set for diesel fuel oils. However relaxing the present volatility specification requirement will permit using an 950° F. end boiling point for the heavy gas oil.

In the particular operating arrangement of the drawing, the atmospheric residua withdrawn by conduit 14 initially boils at least about 750° F. and up to about 800° F. and is passed to a vacuum distillation zone or vacuum tower arrangement 16 wherein a separation is made under subatmospheric pressure conditions to recover a heavy vacuum gas oil boiling up to about 1075° F. from higher boiling material known as vacuum resid. This vacuum resid is recovered by conduit 18 and may be disposed by blending with very heavy fuel oil suitable for some limited use. The separated vacuum gas oil is withdrawn by conduit 20 and passed in one specific embodiment to a fluid catalytic cracking unit (FCC) 22. In the fluid catalyst cracking unit 22, the vacuum gas oil is cracked under conditions selected for providing a maximum distillate producing mode providing up to about 60% light cycle oil and about 40% gasoline with lighter gaseous material. Under such operating conditions, a gasoline product of the fluid cracking operation is produced, lower boiling gaseous material and usually a clarified slurry oil (CSO) is recovered from a product fractionation step of the FCC unit included in box 22 shown on the drawing. The gaseous product comprising primarily $C_4$ minus material is recovered by conduit 24, gasoline boiling range material of end boiling point in the range of 320° F. to about 360° to 380° F. is withdrawn by conduit 26 and a light cycle oil product of the cracking operation and boiling from about 320° F. up to about 660° F. or 700° F. is recovered by conduit 28. The higher boiling clarified slurry oil is withdrawn by conduit 30.

A heavy gas oil product of the atmospheric distillation operation removed by conduit 12 is passed to a special hydrodewaxing operation herein identified and represented by box 37. Light cycle oil in conduit 28 may also be so charged. Hydrodewaxing of the selected heavy gas oil thus recovered with or without light cycle oil of the FCC unit is accomplished preferably in the presence of a special class of crystalline zeolites more fully identified hereinafter and represented by ZSM-5 crystalline zeolite promoted with nickel or other suitable hydrogenating metal component of the Periodic Table.

In a specific embodiment, the special crystalline zeolite such as ZSM-5 zeolite provided with a hydrogenating component such as about 1 wt. % of nickel. The hydrodewaxing operation is maintained particularly to maximize the yield of desired distillate light fuel oil product and thus is a relatively low severity operation relying upon temperatures within the range of 500 to 850° F., more usually, 550° to 750° F.; a pressure less than 1500 psig and, more usually, within the range of 300 to 500 psia is employed. The hydrodewaxing operation is maintained under operating conditions of severity selected to produce a fuel oil product of about 0° F. pour point but this pour point may be lower or higher depending on product quality specifications. Also the fluid oil product may be light or heavier as required for product quality. During the relatively mild severity hydrodewaxing operation, some gasoline product material of acceptable octane rating is produced which comprises from about 40 to 60% olefins. It is contemplated adding a desulfurizing catalyst with the dewaxing catalyst to effect some desulfurization of the heavy gas oil charge to the dewaxing operation. The dewaxing operating conditions are generally sufficient to effect substantial desulfurization of the dewaxed oil product.

In the combination operation herein identified, a light atmospheric gas oil or fuel oil comprising an initial boiling point in the range of 320° to 360° or 380° F. and an end boiling point of about 650° F. recovered from the atmospheric tower 4 by conduit 10 is acceptable product following desulfurization thereof for use as a diesel fuel and/or No. 2 fuel oil. This recovered light gas oil in conduit 10 may be mixed with a dewaxed gas oil or fuel oil recovered from zone 37 by conduit 34 and the light cycle oil in conduit 28 recovered from the cracking zone 22, if not already passed as feed to the dewaxing operation. The combination of light and heavier gas oils thus produced and recovered is passed to a hydrodesulfurizing unit 36.

In desulfurizing unit 36, the operating conditions are selected to effect a hydrogenation and desulfurization of the fuel oil materials charged to the unit to form a product containing not more than about 0.5 weight percent sulfur and preferably not more than about 0.3 weight percent sulfur and a cetane rating of at least 40. Generally, the operating conditions employed in this desulfurizing step of the process will vary with severity of upstream processing conditions and will include a temperature selected from within the range of 500° to 800° F., preferably from 550° to 700° F., relying upon a hydrogen partial pressure selected from within the range of 300 to 1000 psi. The hydrogen pressure more usually is desirably retained below 800 psi for economic reasons. The catalyst employed in the desulfurizing operation may be any of those known and suggested in the prior art suitable for the purpose and include such as nickel-molybdena, nickel-tungsten, nickel-cobalt-molybdenum and cobalt-molybdenum on, for example, an alumina matrix material. The matrix may or may not contain silica.

A diesel fuel oil product and/or No. 2 heating oil is recovered from the desulfurizing unit 36 by conduit 38 as the primary product of interest of the process.

The atmospheric naphtha recovered by conduit 8 from tower 4 and being of low octane is charged to a catalytic reforming operation represented by box 40 wherein the low octane naphtha, of atmospheric distillation and hydrocracking is upgraded to a higher octane product by contact with a suitable reforming catalyst such as platinum and others known in the prior art. Bimetallic reforming catalyst may be used in this reforming operation as has been developed in the more recent years. A gasoline reformate product of desired higher octane of at least 85 or 90 octane is recovered from the reformer 40 by conduit 42. The gasoline product of the fluid cracking operation to maximize fuel oils is removed by conduit 26. This gasoline product, when of acceptable octane value, may be mixed with the reformate in conduit 42. It is also contemplated charging this FCC gasoline product when of undesired low octane to the reforming operation with the atmospheric naphtha as above briefly discussed.

Gaseous $C_4$ minus products of the combination operation and particularly those recovered from the hydrodewaxing operation in conduit 39 and the fluid cracking operation recovered by conduit 24 are mixed with the $C_4$ minus gaseous products recovered by conduit 6 for recovery as LPG product.

As suggested above, a hydrocracking operation may be used in the processing combination of this invention since such an operation in the maximum distillate operating mode produces up to about 85% distillate based on feed to the unit. Thus, it may be preferred to maximize distillate product by hydrocracking technology or hydrogen donor diluent cracking (HDDC) rather than by the FCC operation above briefly discussed. On the other hand it is contemplated processing light vacuum gas oil recovered from vacuum tower 16 in the FCC conversion unit with the heavier vacuum gas oil product of tower 16 being processed as by hydrocracking.

For the purpose of a further discussion, it will be assumed that all of the vacuum tower gas oil withdrawn by conduit 20 is passed in one embodiment to the hydrocracking operation (HDC) represented by box 44. Hydrocracking of the vacuum gas oil in unit 44 is preferably effected under temperature, pressure and space velocity conditions of severity particularly promoting the maximization of distillate product boiling in the diesel fuel oil range. The type of operation particularly desired in unit 44 is generally represented by U.S. Pat. Nos. 3,210,265 and 3,384,572, the disclosure of which is incorporated herein by reference thereto. In this generally low severity operation, some naphtha boiling material is produced and recovered by conduit 48 separately from gaseous $C_4$ minus products recovered by conduit 50 and a diesel fuel oil product recovered by conduit 46. The diesel fuel oil product in conduit 46 is usually suitable for use without desulfurizing thereof and mixed with that in conduit 38 recovered from the desulfurizing operation to form the primary product. The gaseous products of the hydrocracking operation are separated to recover particularly $C_4$ minus LPG product, withdrawn by conduit 50 for admixture with such material in conduit 6. On the other hand, separation of desired LPG product may be accomplished after mixing the gaseous materials in conduits 6 and 50. The naphtha product in conduit 48 may be combined with the reformate gasoline in conduit 42 or it may be fractionated into a light and heavy naphtha and one or both of these fractions and particularly the heavier fraction may be passed by conduit 52 for admixture with the naphtha in conduit 8 charged to reforming unit 40. In this combination of processing steps, it is desirable to select the naphtha charged and reforming operating conditions which will upgrade the low octane naphtha material of the process to produce a gasoline product of at least 90 octane. The technology for upgrading naphtha of the types herein identified to a higher octane product is defined substantially in the prior art.

The catalysts disclosed in the above-recited prior art and briefly identified may be employed in the combination operation of this invention with varying degrees of success because of the activity and selectivity characteristics of different catalyst compositions. It is preferred, however, to employ these catalyst compositions particularly identified with optimizing the production of fuel oils at the expense of gasoline and lower boiling products such as LPG products. In a more particular aspect, the hydrodewaxing operation of this invention is preferably accomplished with a special class of crystalline zeolites represented by ZSM-5, ZSM-11, ZSM-12, ZSM-35 and ZSM-38.

The special zeolites useful as the hydrodewaxing catalyst of the invention have a pore dimension greater than about 5 Angstroms and a structure providing constrained access to large molecules. These special zeolites also provide pore windows of a size provided by a 10-membered ring of oxygen atoms which are formed by the regular disposition of the tetrahedra making up the anionic framework of the crystalline zeolite or aluminosilicate with the oxygen atoms themselves being bonded to the silicon or aluminum atoms at the centers of the tetrahedra. The preferred zeolites of this special class of zeolites have a silica-to-alumina ratio of at least about 12 and, more preferably, at least about 30. Zeolites of the type above particularly identified have a constraint index within the range of 1 to 12. U.S. Pat. No. 3,702,886 describing and claiming ZSM-5 is, therefore, incorporated herein by reference thereto. So also U.S. Pat. No. 3,709,979 describing and claiming ZSM-11, U.S. Pat. No. 3,832,449 describing and claiming ZSM-12, U.S. Pat. No. 4,016,245 describing and claiming ZSM-35, and U.S. Pat. No. 4,046,859 describing and claiming ZSM-38 are incorporated herein by reference thereto.

The conversion process of this invention comprising the hydrocracking operation and the hydrodewaxing operation may be carried out in fixed catalyst bed operations or flowing catalyst operations such as provided by fluid bed, moving bed and riser transport type of operations. The feed material charged to these catalytic operations are separated as hereinbefore provided and comprise high boiling portions of a crude oil. Catalytic hydrodewaxing is known as a process intended for use in lowering the pour point as well as the cloud point of No. 2 or diesel fuel oil. So also will the more severe conversion operation known as hydrocracking with less selectivity than the hydrodewaxing operation of the invention.

Having thus generally discussed the concepts of the present invention and specifically described a processing combination arranged to incorporate the concepts of the invention, it is to be understood that no undue restrictions are to be imposed by reasons thereof except as defined by the following claims.

We claim:

1. A process for upgrading crude oil to fuel oil comprising diesel fuel and No. 2 heating oil which comprises, separating a crude oil to obtain naphtha boiling material, a light gas oil fraction boiling in the range of 320° to 650° F., a heavy atmospheric gas oil with an end boiling point in the range of 750° to 950° F. and a higher boiling atmospheric residua, separating the atmospheric residua to obtain vacuum residua and heavy vacuum gas oil with an end point up to about 1075° F., processing the heavy vacuum gas oil through one or both of catalytic cracking with or without hydrogen under conditions to particularly increase the yield of a cycle oil product suitable for use as diesel fuel with or without further hydrogenation, processing the heavy atmospheric gas oil with an end point in the range of 750° F. to 950° F. by catalytic hydrowaxing with a special class of crystalline zeolites represented by ZSM-5 zeolite to produce particularly a dewaxed gas oil of substantially improved pour point and cetane value, hydrodesulfurizing a dewaxed heavy gas oil product of hydrodewaxing and blending the gas oil products of cracking and dewaxing of acceptable sulfur concentration to form diesel fuel and/or No. 2 heating oil.

2. The process of claim 1 wherein the separated heavy vacuum gas oil is processed by fluid catalytic cracking to produce a light cycle oil thereafter used to increase the yield by blending and form said diesel and heating oil.

3. The process of claim 1 wherein a light vacuum gas oil is separately processed by fluid catalytic cracking and a heavy vacuum gas oil is separately processed by hydrocracking under conditions to particularly form distillate fuel oil products suitable for use by blending in said diesel or heating oil product.

4. The process of claim 1 wherein a light cycle oil product of cracking vacuum gas oil is hydrodewaxed with said atmospheric heavy gas oil and desulfurized to produce diesel and heating oil.

5. The process of claim 1 wherein the naphtha separated from the crude oil and a gasoline product of cracking are reformed to produce a gasoline of at least 85 octane.

6. The process of claim 1 wherein a gasoline product of catalytic cracking in the absence of added hydrogen is blended with reformed straight run naphtha obtained from the crude oil to provide a gasoline product of at least 90 octane.

7. The process of claim 1 wherein $C_4$ minus hydrocarbons obtained from the crude oil and separated from the products of hydrodewaxing and catalytic cracking with or without hydrogen are blended and processed for LPG product.

8. The process of claim 1 wherein the yield of diesel fuel and heating oil product is improved by lowering the initial boiling point of the atmospheric light gas oil separated from the crude oil to provide an initial boiling point of about 320° F., increasing the end boiling point of the heavy atmospheric gas oil separated from the crude oil to an end point in the range of 750° to 950° F. and processing the recovered vacuum gas oil by hydrocracking under conditions to particularly maximize the yield of distillate suitable for diesel fuel boiling range material.

9. The process of claim 1 wherein the dewaxed gas oil product obtained by dewaxing atmospheric heavy gas oil and boiling within the range of 660° to 800° F. is mixed with a light cycle oil product of fluid catalytic cracking and the mixture is then desulfurized to reduce the sulfur content of the diesel fuel to at least 0.5 weight percent.

10. The process of claim 1 wherein the diesel oil product contains not more than 0.3 weight percent sulfur.

* * * * *